US010029894B2

(12) United States Patent
Kochie

(10) Patent No.: US 10,029,894 B2
(45) Date of Patent: Jul. 24, 2018

(54) SMALL VEHICLE ADJUSTABLE LIFT

(71) Applicants: Bosch Automotive Service Solutions Inc., Warren, MI (US); Robert Bosch GmbH, Stuttgart (DE)

(72) Inventor: Robert Kochie, Dodge Center, MN (US)

(73) Assignees: Bosch Automotive Service Solutions Inc., Warrren, MI (US); Robert Bosch GmbH, Stuttgart (DE)

( * ) Notice: Subject to any disclaimer, the term of this patent is extended or adjusted under 35 U.S.C. 154(b) by 210 days.

(21) Appl. No.: 14/980,291

(22) Filed: Dec. 28, 2015

(65) Prior Publication Data

US 2017/0183206 A1 Jun. 29, 2017

(51) Int. Cl.

| | |
|---|---|
| ***B66F 3/22*** | (2006.01) |
| ***B66F 7/06*** | (2006.01) |
| ***B66F 7/28*** | (2006.01) |

(52) U.S. Cl.

CPC ..... *B66F 7/065* (2013.01); *B66F 3/22* (2013.01); *B66F 7/28* (2013.01)

(58) Field of Classification Search

CPC .... B66F 3/22; B66F 7/065; B66F 7/00; B66F 7/20; B66F 9/00; B66F 11/00

See application file for complete search history.

(56) References Cited

U.S. PATENT DOCUMENTS

| | | | | |
|---|---|---|---|---|
| 5,372,353 | A * | 12/1994 | West | B25H 1/0007 254/10 B |
| 5,695,173 | A * | 12/1997 | Ochoa | B66F 7/065 254/10 C |
| 7,055,802 | B1 * | 6/2006 | Jones | B62B 1/002 254/122 |
| 2006/0054395 | A1 * | 3/2006 | Kovacic | B66F 7/0625 182/141 |
| 2006/0186386 | A1 * | 8/2006 | Landsberger | B01L 9/00 254/106 |
| 2012/0118671 | A1 | 5/2012 | Fiorese | |
| 2017/0183206 | A1 * | 6/2017 | Kochie | B66F 3/22 |

FOREIGN PATENT DOCUMENTS

| | | | |
|---|---|---|---|
| DE | 1692582 | U | 2/1955 |
| DE | 1231402 | | 12/1966 |
| DE | 19512063 | A1 | 10/1996 |
| EP | 2048107 | A1 | 4/2009 |

* cited by examiner

*Primary Examiner* — Lee D Wilson
(74) *Attorney, Agent, or Firm* — Maginot Moore & Beck LLP

(57) ABSTRACT

A small vehicle adjustable lift in one embodiment includes at least one horizontally extending base support, a first riser support including a first end portion supported by the at least one horizontal base support, and a second end portion vertically movable with respect to the at least one horizontally extending base support, a second riser support including a third end portion supported by the at least one horizontal base support, and a fourth end portion vertically movable with respect to the at least one horizontally extending base support, a first vehicle support supported by the second end portion and vertically adjustable with respect to the second end portion, and a second vehicle support supported by the fourth end portion and vertically adjustable with respect to the fourth end portion.

18 Claims, 2 Drawing Sheets

SMALL VEHICLE ADJUSTABLE LIFT

FIELD

The present disclosure relates to lifting apparatuses, and more particularly, to lifting apparatuses for small vehicles such as motorcycles, all-terrain vehicles ("ATV"), and the like.

BACKGROUND

Small vehicles such as riding lawn mowers, ATV's, motorcycles, and the like are commonplace vehicles used in a variety of endeavors including transportation, recreation, and tasks including hauling and snow removal. Like any other mechanical device, these vehicles require maintenance/component updates including oil changes, lubrication, repair of failed parts, replacement of parts with alternative parts, etc. Motorcycles in particular are commonly modified with aftermarket parts. While these procedures can be performed at a business providing such services, owners of the small vehicles frequently desire to perform the work themselves.

In order to properly access a vehicle either for maintenance or part modification, it is frequently required to elevate the vehicle in order to gain access to a particular location of the vehicle. Vehicle elevation presents a number of challenges. For example, some vehicles include lower hanging components which restrict access to a vehicle's frame. Lower hanging components can include shock absorbers, exhaust systems, and oil pans. Lifting on non-frame components, however, can potentially damage the components. Additionally, structural failure of the components can result in the vehicle falling from the elevated position causing vehicular damage as well as endangering personnel working on or near the vehicle.

Moreover, even if a lift is specially designed to contact specific frame positions on a vehicle, some components on vehicles are after-market devices. As such, the components can interfere with frame positions preferred for supporting the weight of a vehicle. Consequently, the user is forced to add blocks or similar objects to a lift which may not be securely attached to the lift, thereby making for an unsafe lifting process.

Accordingly, there is a need for a lift for small vehicles which allows a user to configure the lift for a particular small vehicle configuration. It would be advantageous for such a lift to provide enhanced safety and security when the small vehicle is in an elevated position.

SUMMARY

In accordance with one embodiment, a small vehicle adjustable lift includes at least one horizontally extending base support, a first riser support including a first end portion supported by the at least one horizontal base support, and a second end portion vertically movable with respect to the at least one horizontally extending base support, a second riser support including a third end portion supported by the at least one horizontal base support, and a fourth end portion vertically movable with respect to the at least one horizontally extending base support, a first vehicle support supported by the second end portion and vertically adjustable with respect to the second end portion, and a second vehicle support supported by the fourth end portion and vertically adjustable with respect to the fourth end portion.

In one or more embodiments, a small vehicle adjustable lift includes a first cross-support extending between the first riser support and the second riser support, wherein the first riser support is pivotably connected to the second riser support at a location between the first end portion and the second end portion, the first vehicle support is supported by the second end portion through the first cross-support, the second vehicle support is supported by the fourth end portion through the first cross-support, and the first vehicle support is horizontally movable along the first cross-support.

In one or more embodiments, the second vehicle support is horizontally movable along the first cross-support.

In one or more embodiments, the second vehicle support is horizontally movable along the first cross-support independent of the first vehicle support.

In one or more embodiments, a small vehicle adjustable lift includes a third riser support including a fifth end portion supported by the at least one horizontal base support, and a sixth end portion vertically movable with respect to the at least one horizontally extending base support, a fourth riser support including a seventh end portion supported by the at least one horizontal base support, and an eighth end portion vertically movable with respect to the at least one horizontally extending base support, a third vehicle support supported by the sixth end portion and vertically adjustable with respect to the sixth end portion, and a fourth vehicle support supported by the eighth end portion and vertically adjustable with respect to the eighth end portion.

In one or more embodiments, a small vehicle adjustable lift includes a second cross-support extending between the third riser support and the fourth riser support, wherein the third riser support is pivotably connected to the fourth riser support at a location between the fifth end portion and the sixth end portion, the third vehicle support is supported by the sixth end portion through the second cross-support, the fourth vehicle support is supported by the eighth end portion through the second cross-support, and the third vehicle support is horizontally movable along the second cross-support.

In one or more embodiments, the second vehicle support is horizontally movable along the first cross-support, and the fourth vehicle support is horizontally movable along the second cross-support.

In one or more embodiments, the first riser support is pivotably connected to a first of the at least one horizontally extending base supports, the second riser support is pivotably connected to a second of the at least one horizontally extending base supports, the third riser support is pivotably connected to the first of the at least one horizontally extending base supports, and the fourth riser support is pivotably connected to the second of the at least one horizontally extending base supports.

In one or more embodiments, a small vehicle adjustable lift includes an actuator operably engaged with the first of the at least one horizontally extending base supports and configured such that rotation of the actuator in a first direction causes the first of the at least one horizontally extending base supports to move horizontally closer to the second of the at least one horizontally extending base supports.

In one or more embodiments, the actuator is threadedly engaged with the first of the at least one horizontally extending base supports.

In one or more embodiments, a small vehicle adjustable lift includes a frame assembly, wherein the first of the at least one horizontally extending base supports is slidingly supported by the frame assembly, the second of the at least one horizontally extending base supports is slidingly supported by the frame assembly, and the frame assembly includes a ramp portion configured to allow a small vehicle to be positioned above the first, second, third, and fourth vehicle supports.

In accordance with another embodiment, a method of operating a small vehicle lift includes supporting a first vehicle support with a first end portion of a first riser support of a small vehicle lift, supporting a second vehicle support with a second end portion of a second riser support of the small vehicle lift, positioning a small vehicle above the supported first vehicle support and the supported second vehicle support, vertically adjusting the first vehicle support into contact with the positioned small vehicle, vertically adjusting the second vehicle support into contact with the positioned small vehicle, and forcing the first end portion and the second end portion vertically upwardly with respect to at least one horizontally extending base support after vertically adjusting the first and second vehicle support.

In one or more embodiments, a method of using a small vehicle adjustable lift includes moving the first vehicle support horizontally across a first cross-support supported by the first and second end portions after positioning the small vehicle above the supported first vehicle support and before vertically adjusting the first vehicle support.

In one or more embodiments, forcing the first end portion and the second end portion vertically upwardly comprises pivoting the first riser support with respect to the second riser support using a first pivot operably connected to the first riser support and the second riser support.

In one or more embodiments, a method of using a small vehicle adjustable lift includes moving the second vehicle support horizontally across the first cross-support after positioning the small vehicle above the supported second vehicle support and before vertically adjusting the second vehicle support.

In one or more embodiments, moving the second vehicle support horizontally occurs after moving the first vehicle support horizontally.

In one or more embodiments, a method of using a small vehicle adjustable lift includes supporting a third vehicle support with a third end portion of a third riser support of the small vehicle lift, supporting a fourth vehicle support with a fourth end portion of a fourth riser support of the small vehicle lift, vertically adjusting the third vehicle support into contact with the positioned small vehicle, vertically adjusting the fourth vehicle support into contact with the positioned small vehicle, and forcing the third end portion and the fourth end portion vertically upwardly with respect to the at least one horizontally extending base support after vertically adjusting the third and fourth vehicle support.

In one or more embodiments, a method of using a small vehicle adjustable lift includes moving the third vehicle support horizontally across a second cross-support supported by the third and fourth end portions.

In one or more embodiments, forcing the third end portion and the fourth end portion vertically upwardly comprises pivoting the third riser support with respect to the fourth riser support using a second pivot operably connected to the third riser support and the fourth riser support.

In one or more embodiments, a method of using a small vehicle adjustable lift includes moving the fourth vehicle support horizontally across the second cross-support.

BRIEF DESCRIPTION OF THE DRAWINGS

The accompanying drawings illustrate various embodiments of the present disclosure and together with a description serve to explain the principles of the disclosure.

Corresponding reference characters indicate corresponding parts throughout the several views. Like reference characters indicate like parts throughout the several views.

DETAIL DESCRIPTION OF THE DISCLOSURE

Figure 1:
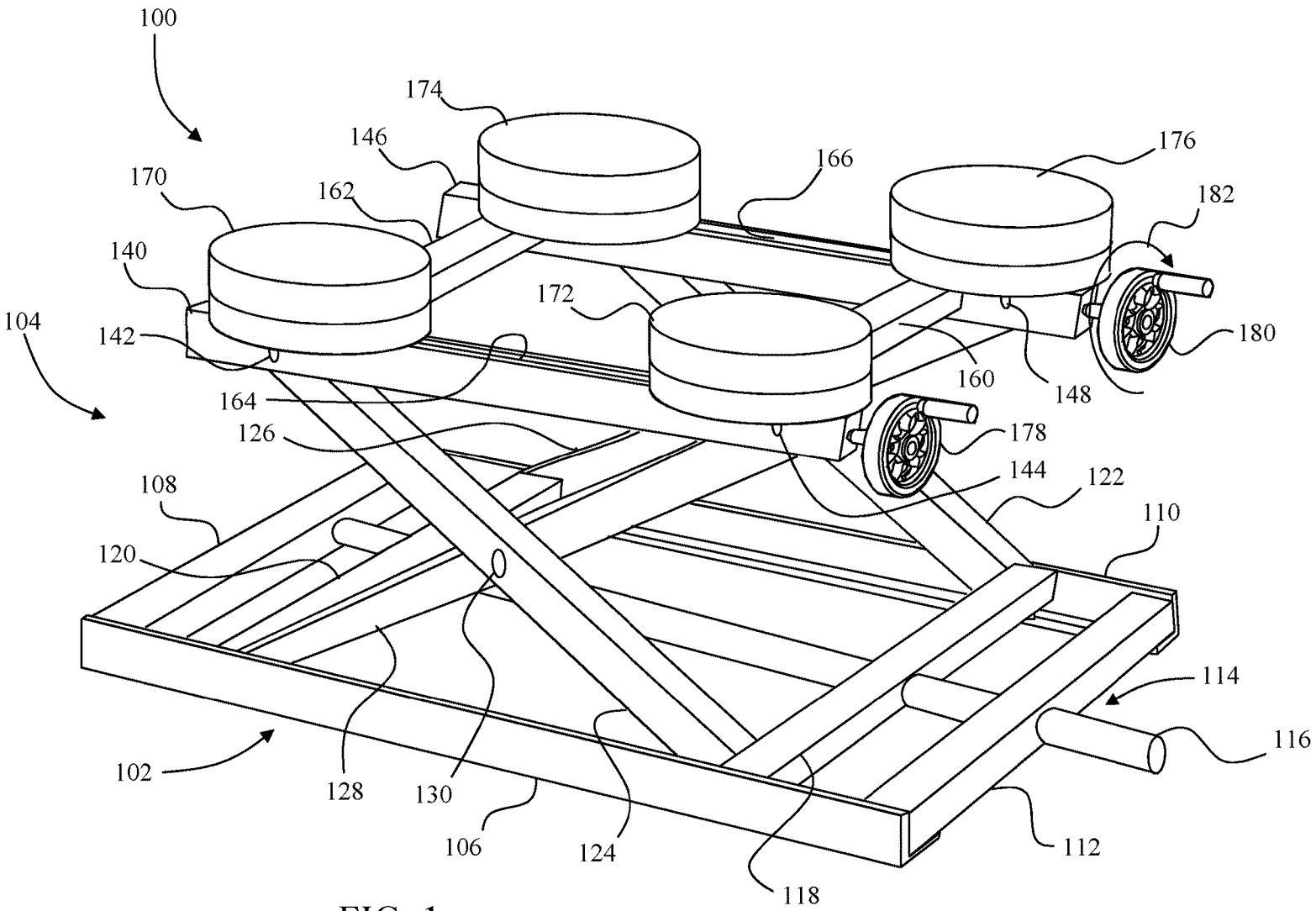
FIG. 1 depicts a perspective view of a small vehicle lift with adjustable lift supports in accordance with the disclosure.

While the systems and processes described herein are susceptible to various modifications and alternative forms, specific embodiments thereof have been shown by way of example in the drawings and will herein be described in detail. It should be understood, however, that there is no intent to limit the systems and processes to the particular forms disclosed. On the contrary, the disclosure is to cover all modifications, equivalents, and alternatives falling within the spirit and scope of the disclosure.

FIG. 1 depicts a small vehicle adjustable lift 100. The lift 100 includes a fixed frame 102 and a riser portion 104. The fixed frame 102 includes fixed frame members 106, 108, 110, and 112. The fixed frame member 112 includes a bore 114 through which an actuator 116 extends. The actuator 116 is rotatably supported by the fixed frame member 112 and the fixed frame member 108.

The actuator 116 is operably engaged with two horizontally extending base supports 118 and 120. The base supports 118 and 120 are slidingly supported by the fixed frame members 106 and 110. The base support 118 supports one end of a riser support 122 and one end of a riser support 124. The base support 120 supports one end of a riser support 126 and one end of a riser support 128. In the embodiment of FIG. 1, the riser supports are pivotably mounted to the respective horizontal base supports. In other embodiments, the riser supports are fixedly connected to the respective horizontal base supports and the horizontal base supports are pivotably connected to the actuator 116.

The riser supports 124 and 128 are pivotably connected by a pivot 130 while the riser supports 122 and 126 are pivotably connected by another pivot (not shown). The pivots provide for increased stability for the riser supports, but in some embodiments are omitted. The riser supports 124 and 128 are further pivotably connected to a cross-support 140 by pivots 142 and 144, respectively. The riser support 126 is pivotably connected to a cross-support 146 by a pivot 148. The riser support 122 is also pivotably connected to the cross-support 146 by a pivot (not shown).

Two cross-braces 160 and 162 fixedly extend between the cross-supports 140/146. Each of the cross-supports 140/146 includes a respective channel 164/166. Two vehicle supports 170/172 are movably supported within the channel 164 while two vehicle supports 174/176 are movably supported within the channel 166. The vehicle supports 170 and 172 are moved within the channel using a wheel 178 while the vehicle supports 174 and 176 are moved within the channel using a wheel 180.

Figure 2:
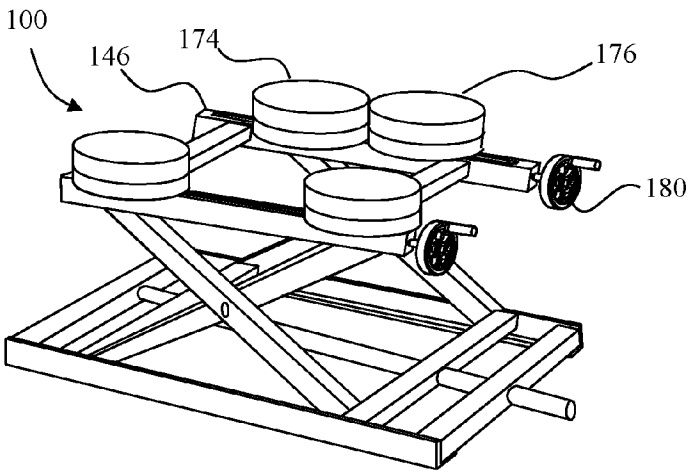
FIG. 2 depicts a perspective side view of the small vehicle lift of FIG. 1 with two of the adjustable vehicle supports horizontally repositioned.

By way of example, rotation of the wheel 180 in the direction of the arrow 182 causes the vehicle supports 174 and 176 to move from the position of FIG. 1 toward each other until they reach the position shown in FIG. 2. Rotation of the wheel 180 in the opposite direction causes the vehicle supports 174/176 to move away from each other. This is accomplished in one embodiment by the use of a double threaded screw positioned within the channel 166 and operably connected to the wheel 180 in a manner known in the art. In other embodiments, each vehicle support is independently controlled such as by using a dedicated screw and wheel for each vehicle support. In still further embodiments, each vehicle support is provided with a clamping assembly which allows for clamping of the vehicle support at any desired location along the respective cross-support.

Each of the vehicle supports 170/172/174/176 is an assembly including a base portion and a support portion as described with reference to FIG. 3. The vehicle support 170 includes a base portion 184 and a support portion 186. The base portion 184 is configured to slidingly engage the cross-support 140 while the support portion 186 is configured to contact a vehicle. In order to provide contact with a vehicle with each of the vehicle supports 170/172/174/176, each of the vehicle supports 170/172/174/176 includes a support portion which is vertically adjustable with respect to the base portion.

Figure 3:
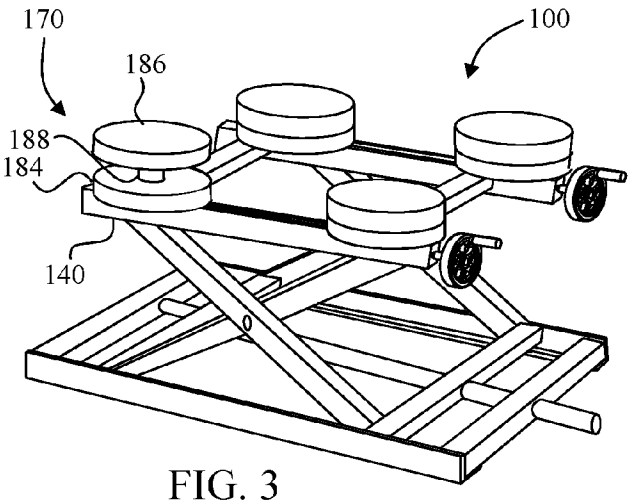
FIG. 3 depicts a perspective side view of the small vehicle lift of FIG. 1 with one of the adjustable vehicle supports vertically raised.

Thus, as depicted in FIG. 3, the support portion 186 can be spaced apart from the base portion 184 by a desired amount. This is accomplished in the embodiment of FIG. 3 by using a threaded member 188 which is fixedly attached to one of the base portion 184 and the support portion 186 and threadedly engaged with the other of the base portion 184 and the support portion 186. Accordingly, rotation of the support portion 186 will cause the support portion 186 to move vertically either toward or away from the base portion 184 depending upon the direction of rotation and the threading. In other embodiments, a clamp is used to position the support portion along a pipe. This type of system is useful in embodiments wherein a shaped support portion 186 is used.

Figure 4:
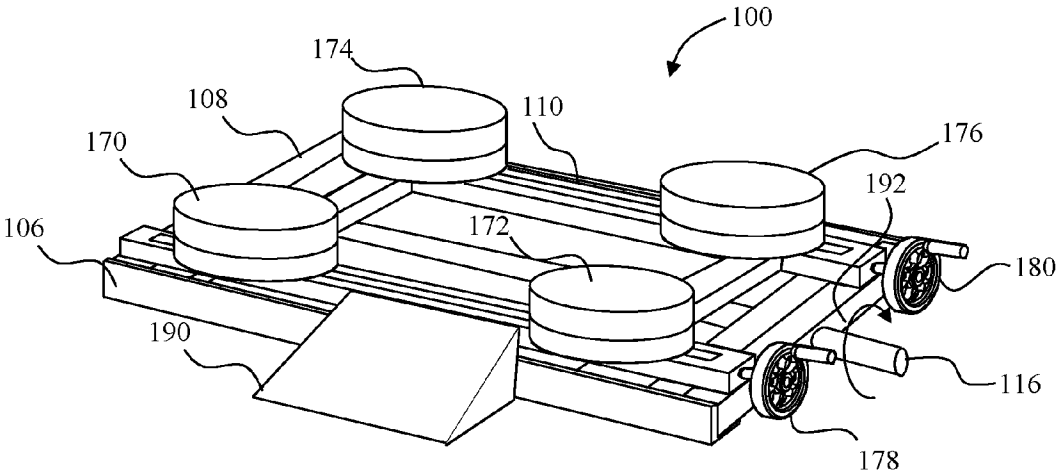
FIG. 4 depicts a perspective side view of the small vehicle lift of FIG. 1 in a lowered position an including a ramp to assist in positioning a small vehicle above the vehicle supports.

In operation, the lift 100 is placed into a lowered position as depicted in FIG. 4 and a vehicle (not shown) is positioned generally above the lift 100. For some vehicles, a ramp 190 may be used to assist in positioning the vehicle. The ramp 190 is shown attached to or integrally formed with the frame member 106, but in some embodiments the ramp 190 is attached to or integrally formed with the frame member 108 or 110.

Once the vehicle is positioned, the actuator 116 and the vehicle supports are used to provide four points of support for the vehicle. First, the actuator 116 is rotated in the direction of the arrow 192 to lift the vehicle supports to a location proximate the vehicle. The actuator in some embodiments is manually rotated. In other embodiments, an electric or hydraulic motor (not shown) is used to rotate the actuator 116. In further embodiments, a lever ramp or a jack is used to move the cross-supports 140/146 upwardly.

The wheels 178 and 180 are then used to position the vehicle supports 170/172/174 and 176 directly beneath respective frame portions of the vehicle which are configured to bear the weight of the vehicle. Each vehicle support 170/172/174 and 176 is then adjusted vertically to place the vehicle support 170/172/174 and 176 in contact with the frame of the vehicle. In some embodiments, one or more of the vehicle supports 170/172/174/176 are placed into contact simply by raising the riser portion 104.

Once the desired contact is provided using the vehicle supports 170/172/174 and 176, the riser portion is raised to the desired height using the actuator 116. In some embodiments, lock pins (not shown) are used to secure the horizontal base supports 118/120 to the fixed frame members 106/110. After work on the vehicle is completed, the above process is reversed to lower the riser portion 104.

The foregoing operation is modified as desired for various embodiments. By way of example, in some embodiments the lift is provided in the form of a kit. The kit may include vehicle supports which are specifically shaped for a particular vehicle. In these embodiments, the appropriate vehicle supports are positioned in the cross-supports 140/146 at any time prior to raising the support portion of the vehicle supports. Shaped support portions will typically not be raised using a threaded connection, although this is possible. Rather, a clamping mechanism is preferably incorporated.

Additionally, in some embodiments indicia for proper location of the vehicle supports is provided on the cross-supports 140/146. In these embodiments, the vehicle supports may be horizontally positioned prior to raising the riser portion. Likewise, vehicle supports may be provided with indicia which can be used to pre-set the appropriate vertical height of the support portions for a particular vehicle.

The disclosed lift and method of using the lift thus provides individual support portions or lift pads that locate onto four points on the lower frame rails of a vehicle. This accommodates vehicles with different frame widths and heights. The pads/support portions in different embodiments move individually or in conjunction with each other in the horizontal axis for a custom fit on the frame. This allows for lifting a vehicle without resort to shift space blocks resulting in increased safety for a user.

While the disclosure has been illustrated and described in detail in the drawings and foregoing description, the same should be considered as illustrative and not restrictive in character. It is understood that only the preferred embodiments have been presented and that all changes, modifications and further applications that come within the spirit of the disclosure are desired to be protected.

The invention claimed is:

1. A small vehicle adjustable lift, comprising:

at least one horizontally extending base support;

a first riser support including a first end portion supported by the at least one horizontal base support, and a second end portion supported by the at least one horizontal base support through the first end portion and vertically movable with respect to the at least one horizontally extending base support;

a second riser support including a third end portion supported by the at least one horizontal base support, and a fourth end portion supported by the at least one horizontal base support through the third end portion and vertically movable with respect to the at least one horizontally extending base support and the third end portion;

a first vehicle support supported by the first end portion through the second end portion and vertically adjustable with respect to the second end portion;

a second vehicle support supported by the third end portion through the fourth end portion and vertically adjustable with respect to the fourth end portion; and a first cross-support extending between the first riser support and the second riser support, wherein:

the first riser support is pivotably connected to the second riser support at a location between the first end portion and the second end portion;

the first vehicle support is supported by the second end portion through the first cross-support;

the second vehicle support is supported by the fourth end portion through the first cross-support; and the first vehicle support is horizontally movable along the first cross-support.

2. The small vehicle adjustable lift of claim 1, wherein the second vehicle support is horizontally movable along the first cross-support.

3. The small vehicle adjustable lift of claim 2, wherein the second vehicle support is horizontally movable along the first cross-support independent of the first vehicle support.

4. The small vehicle adjustable lift of claim 1, further comprising:

a third riser support including a fifth end portion supported by the at least one horizontal base support, and a sixth end portion vertically movable with respect to the at least one horizontally extending base support;

a fourth riser support including a seventh end portion supported by the at least one horizontal base support, and an eighth end portion vertically movable with respect to the at least one horizontally extending base support;

a third vehicle support supported by the sixth end portion and vertically adjustable with respect to the sixth end portion; and a fourth vehicle support supported by the eighth end portion and vertically adjustable with respect to the eighth end portion.

5. The small vehicle adjustable lift of claim 4, further comprising a second cross-support extending between the third riser support and the fourth riser support, wherein:

the third riser support is pivotably connected to the fourth riser support at a location between the fifth end portion and the sixth end portion;

the third vehicle support is supported by the sixth end portion through the second cross-support;

the fourth vehicle support is supported by the eighth end portion through the second cross-support; and the third vehicle support is horizontally movable along the second cross-support.

6. The small vehicle lift of claim 5, wherein:

the second vehicle support is horizontally movable along the first cross-support; and the fourth vehicle support is horizontally movable along the second cross-support.

7. The small vehicle lift of claim 5, wherein:

the first riser support is pivotably connected to a first of the at least one horizontally extending base supports;

the second riser support is pivotably connected to a second of the at least one horizontally extending base supports;

the third riser support is pivotably connected to the first of the at least one horizontally extending base supports; and the fourth riser support is pivotably connected to the second of the at least one horizontally extending base supports.

8. The small vehicle lift of claim 7, further comprising:

an actuator operably engaged with the first of the at least one horizontally extending base supports and configured such that rotation of the actuator in a first direction causes the first of the at least one horizontally extending base supports to move horizontally closer to the second of the at least one horizontally extending base supports.

9. The small vehicle lift of claim 8, wherein the actuator is threadedly engaged with the first of the at least one horizontally extending base supports.

10. The small vehicle lift of claim 7, further comprising a frame assembly, wherein:

the first of the at least one horizontally extending base supports is slidingly supported by the frame assembly;

the second of the at least one horizontally extending base supports is slidingly supported by the frame assembly; and the frame assembly includes a ramp portion configured to allow a small vehicle to be positioned above the first, second, third, and fourth vehicle supports.

11. A method of operating a small vehicle adjustable lift, comprising:

supporting a first vehicle support with a first end portion of a first riser support of a small vehicle lift;

supporting a second vehicle support with a second end portion of a second riser support of the small vehicle lift;

positioning a small vehicle above the supported first vehicle support and the supported second vehicle support;

moving the first vehicle support horizontally across a first cross-support supported by the first and second end portions after positioning the small vehicle above the supported first vehicle support and before vertically adjusting the first vehicle support;

vertically adjusting the first vehicle support into contact with the positioned small vehicle;

vertically adjusting the second vehicle support into contact with the positioned small vehicle; and forcing the first end portion and the second end portion vertically upwardly with respect to at least one horizontally extending base support after vertically adjusting the first and second vehicle support.

12. The method of claim 11, wherein:

forcing the first end portion and the second end portion vertically upwardly comprises pivoting the first riser support with respect to the second riser support using a first pivot operably connected to the first riser support and the second riser support.

13. The method of claim 12, further comprising:

moving the second vehicle support horizontally across the first cross-support after positioning the small vehicle above the supported second vehicle support and before vertically adjusting the second vehicle support.

14. The method of claim 13, wherein moving the second vehicle support horizontally occurs after moving the first vehicle support horizontally.

15. The method of claim 13, further comprising:

supporting a third vehicle support with a third end portion of a third riser support of the small vehicle lift;

supporting a fourth vehicle support with a fourth end portion of a fourth riser support of the small vehicle lift;

vertically adjusting the third vehicle support into contact with the positioned small vehicle;

vertically adjusting the fourth vehicle support into contact with the positioned small vehicle; and forcing the third end portion and the fourth end portion vertically upwardly with respect to the at least one horizontally extending base support after vertically adjusting the third and fourth vehicle support.

16. The method of claim 15, further comprising:

moving the third vehicle support horizontally across a second cross-support supported by the third and fourth end portions.

17. The method of claim 16, wherein:

forcing the third end portion and the fourth end portion vertically upwardly comprises pivoting the third riser support with respect to the fourth riser support using a second pivot operably connected to the third riser support and the fourth riser support.

18. The method of claim 17, further comprising:

moving the fourth vehicle support horizontally across the second cross-support.

* * * * *